US008402564B2

(12) United States Patent
Duwyn-Zylstra

(10) Patent No.: US 8,402,564 B2
(45) Date of Patent: Mar. 26, 2013

(54) ADJUSTABLE HAT

(75) Inventor: Ann-Marie Duwyn-Zylstra, Niagara Falls (CA)

(73) Assignee: Anne-Marie Duwyn-Zylstra, Niagara Falls (CA)

( * ) Notice: Subject to any disclaimer, the term of this patent is extended or adjusted under 35 U.S.C. 154(b) by 0 days.

(21) Appl. No.: 12/916,079

(22) Filed: Oct. 29, 2010

(65) Prior Publication Data

US 2011/0099691 A1 May 5, 2011

Related U.S. Application Data

(63) Continuation of application No. 12/609,895, filed on Oct. 30, 2009.

(51) Int. Cl.
*A42B 1/00* (2006.01)

(52) U.S. Cl. ..... 2/175.1; 2/175.3; 2/183; 2/181; 2/209.11; 2/209.12

(58) Field of Classification Search ..... 2/183, 175.4, 2/195.2, 171, 171.5, 171.4, 181, 171.7, 171.8, 2/181.2, 182.1, 182.5, 182.6, 175.1, 175.6, 2/175.7, 195.1, 195.5, 209.5, 208, 209, 174, 2/172, 202–205, 84; 24/115 G
See application file for complete search history.

(56) References Cited

U.S. PATENT DOCUMENTS 191,061 A * 5/1877 Kuhlman ..... 2/272
240,351 A * 4/1881 Adams ..... 2/172
658,124 A * 9/1900 Semple ..... 24/165
809,947 A * 1/1906 Herndon ..... 2/68
889,640 A * 6/1908 Sherman ..... 2/172
946,770 A * 1/1910 Sands ..... 2/68
1,081,333 A * 12/1913 Reese ..... 2/172
1,364,669 A * 1/1921 Winch ..... 2/172
1,441,180 A * 1/1923 Gwilym ..... 2/68
1,481,541 A * 1/1924 Douglas ..... 2/172
1,534,181 A * 4/1925 Samuel ..... 2/183
1,557,280 A * 10/1925 Watson ..... 2/181
1,594,206 A * 7/1926 Knapp ..... 132/274
1,674,361 A * 6/1928 Gstalder ..... 2/181
1,992,285 A * 2/1935 Blum ..... 2/183
2,055,560 A * 9/1936 Rose ..... 2/206
2,127,797 A * 8/1938 Edward ..... 2/182.6
2,138,225 A * 11/1938 Borkland ..... 2/181.8
2,192,341 A * 3/1940 Dahlberg ..... 2/203
2,381,738 A * 8/1945 Grannan ..... 2/204
2,417,986 A * 3/1947 Marder et al. ..... 2/195.1
2,420,937 A * 5/1947 Dauster ..... 2/419
2,624,052 A * 1/1953 Redlin ..... 2/204
3,082,428 A * 3/1963 Zbikowski ..... 2/418
3,276,038 A * 10/1966 Joseph ..... 2/172
(Continued)

*Primary Examiner* — Khoa Huynh
*Assistant Examiner* — Brieanna Fuller
(74) *Attorney, Agent, or Firm* — Gowling Lafleur Henderson LLP

(57) ABSTRACT

A fitting system for a hat includes a band configured to be coupled to the hat; and a resilient member disposed within at least a portion of the band. The resilient member includes a first end, a second end, and an intermediate portion between the first and second ends. A crown extension and a crown extension bottom edge extend downwardly below a circumferential bottom edge of the hat wherein the resilient member is only positioned within a front band portion, a first side band portion, a second side band portion, and the crown extension. The first side band portion and the second side band portion are adapted to attach to the crown to form side gaps. Each of the side gaps are designed to receive the top portion of the user's ear so that the hat is designed to sit lower on the user's head without impinging upon the user's ears while the hat is being worn. A system and method are provided.

13 Claims, 9 Drawing Sheets

U.S. PATENT DOCUMENTS 3,370,304 A * 2/1968 Pelletier ..... 2/174
4,334,325 A * 6/1982 Walkuski ..... 2/202
4,843,642 A * 7/1989 Brower ..... 2/6.6
4,845,782 A * 7/1989 Gregg ..... 2/172
5,121,508 A * 6/1992 Grilliot et al. ..... 2/421
D339,677 S * 9/1993 Kang ..... D2/875
5,253,598 A * 10/1993 Rinehuls ..... 112/475.11
5,351,343 A * 10/1994 Harbison ..... 2/423
5,694,648 A * 12/1997 Nucifora ..... 2/172
D397,239 S * 8/1998 Marrs ..... D2/882
5,896,623 A * 4/1999 Martin ..... 24/16 PB
D413,710 S * 9/1999 De Rugeriis ..... D2/894
6,467,096 B1 * 10/2002 Coluccio ..... 2/195.2
7,082,620 B1 * 8/2006 Rongione ..... 2/181
2002/0162160 A1 * 11/2002 Anderson ..... 2/200.1

* cited by examiner

ADJUSTABLE HAT

CROSS-REFERENCE TO RELATED APPLICATION

This application is a Continuation of U.S. Non-Provisional application Ser. No. 12/609,895 filed Oct. 30, 2009, and claims the benefit of priority thereto.

BACKGROUND OF INVENTION

This application relates generally to hats and more particularly to adjustable hats.

SUMMARY

Hats are popular outerwear. Hats are frequently used to provide cover from the sun, rain and other elements. Given the numerous sized heads among the population, hats come in different preset sizes or are adjustable to accommodate a variety of users. Furthermore, hats not only provide protection, but are also frequently used as fashion accessories. This application discloses an adjustable hat that is comfortable, provides protection and optionally includes a variety of ornamental aspects for a user to selectively incorporate in the hat.

In particular, this application discloses a hat comprising: a crown comprising: a front having a first height; a rear having a second height wherein the second height is greater than the first height; an interior including a forward portion; an exterior including a rearward portion; and a circumferential bottom edge separating the interior and exterior; a band coupled to the interior of the crown; and a resilient member having a first end, a second end, and an intermediate portion between the first and second ends, wherein the first end extends through the exterior rearward portion of the crown, and wherein the second end extends through the exterior rearward portion of the crown, and wherein the intermediate portion is positioned between the band and the interior of the crown.

This application also discloses a hat comprising: a crown comprising: an interior including a front portion; an exterior including a rear portion; a circumferential bottom edge separating the interior and exterior; and wherein the crown is sized so that the bottom edge rests below the entire external occipital protuberance of a user; a band coupled to the interior of the crown; and a resilient member having a first end, a second end, and an intermediate portion between the first and second ends, wherein the first end extends through the exterior rear portion of the crown, and wherein the second end extends through the exterior rear portion of the crown, and wherein the intermediate portion is positioned between the band and the interior of the crown.

This application further discloses a fitting system for a hat, the fitting system comprising: a band configured to be coupled to the hat; and a resilient member disposed within at least a portion of the band, the resilient member comprising a first end, a second end, and an intermediate portion between the first and second ends.

This application also discloses a method for creating an adjustable hat comprising: providing a hat comprising a crown and a circumferential bottom edge; providing a fitting system, the fitting system comprising: a band configured to be coupled to the hat; and a resilient member disposed within at least a portion of the band, the resilient member comprising a first end, a second end, and an intermediate portion between the first and second ends; and coupling the band to one or more of the hat crown and hat bottom edge.

BRIEF DESCRIPTION OF THE DRAWINGS

The drawings, when considered in connection with the following description, are presented for the purpose of facilitating an understanding of the subject matter sought to be protected.

FIG. 7C is a bottom view of the hat of FIG. 7A;

FIG. 7D is a schematic view of a fitting system for a hat;

DETAILED DESCRIPTION

Referring now to FIGS. 1-6, an illustrative hat 100 is shown. The hat 100 generally includes a crown 102, a band 104 and a resilient member 106. While the illustrative hat 100 is shown as a bucket-style hat, it will be appreciated that the hat 100 may have any suitable style configuration and remain within the scope of the present disclosure, including, but not limited to, derby, akubra, cowboy, fedora, gatsby, hardee, panama, beret, slouch, sombrero, trilby, etc. The hat 100 may be formed from any suitable material. In one embodiment, the hat 100 is formed from a material having a UV 50+ rating that is also wicking and breathable. Additionally, in one embodiment, at least a portion of the hat 100 may be formed from a reflective material.

Figure 1A:
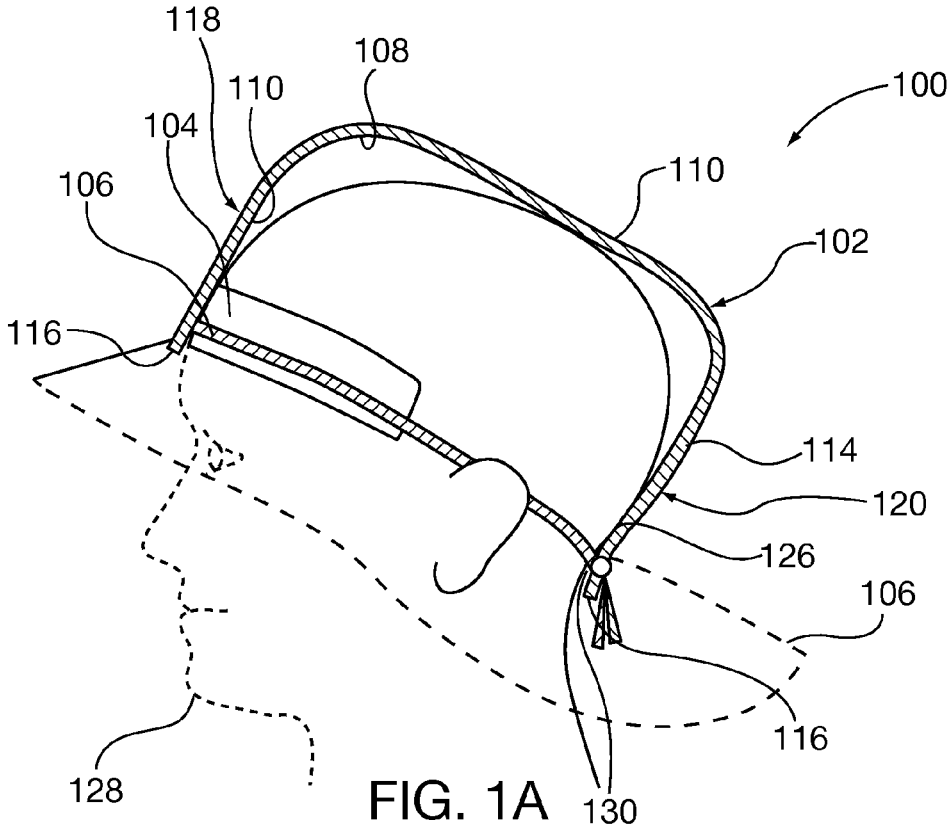
FIG. 1*a* is a schematic side view of a first embodiment of a hat.
Figure 1B:
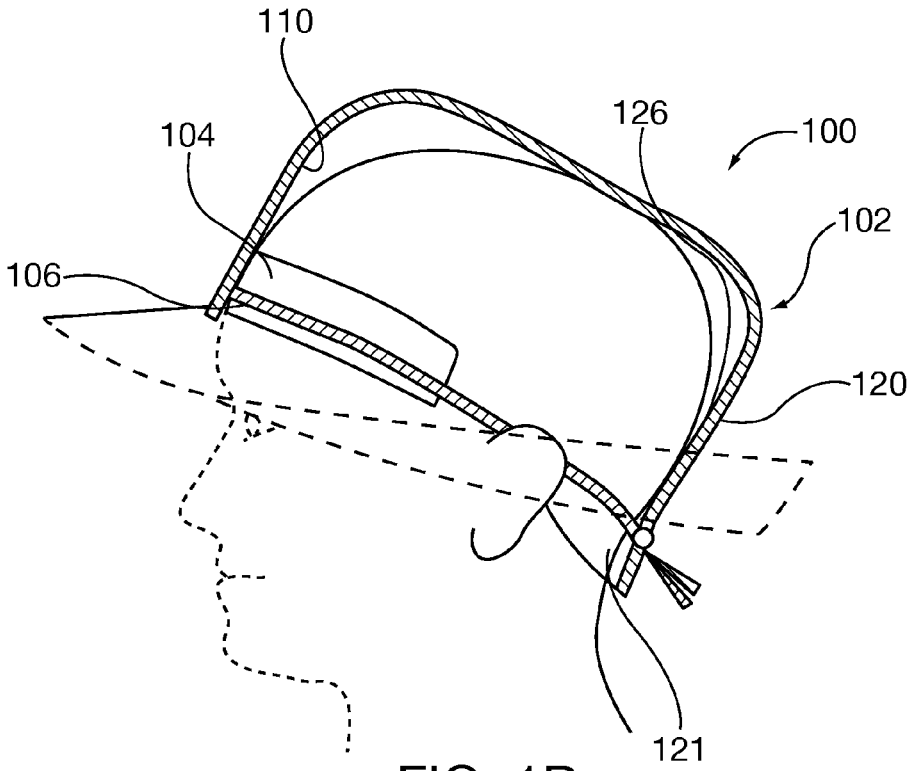
FIG. 1*b* is a schematic side view of a second embodiment of a hat.
Figure 2:
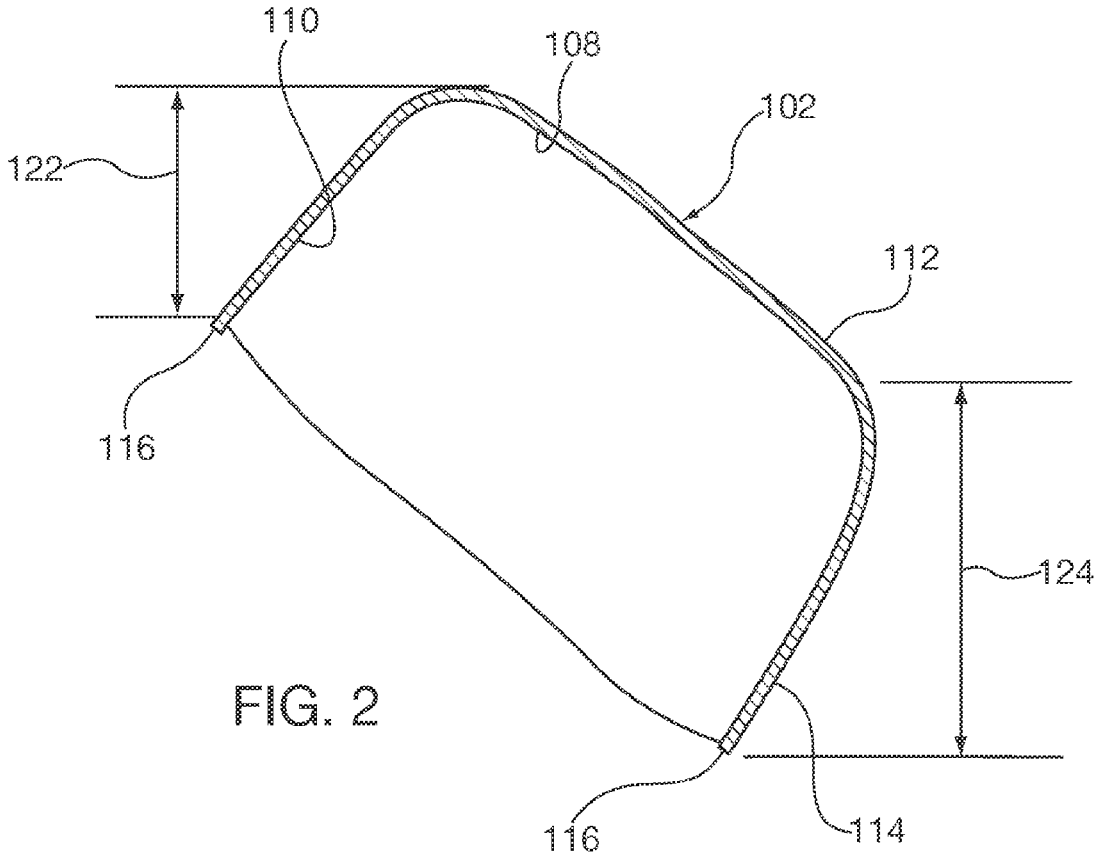
FIG. 2 is a schematic, cross-sectional view of a crown.
Figure 3:
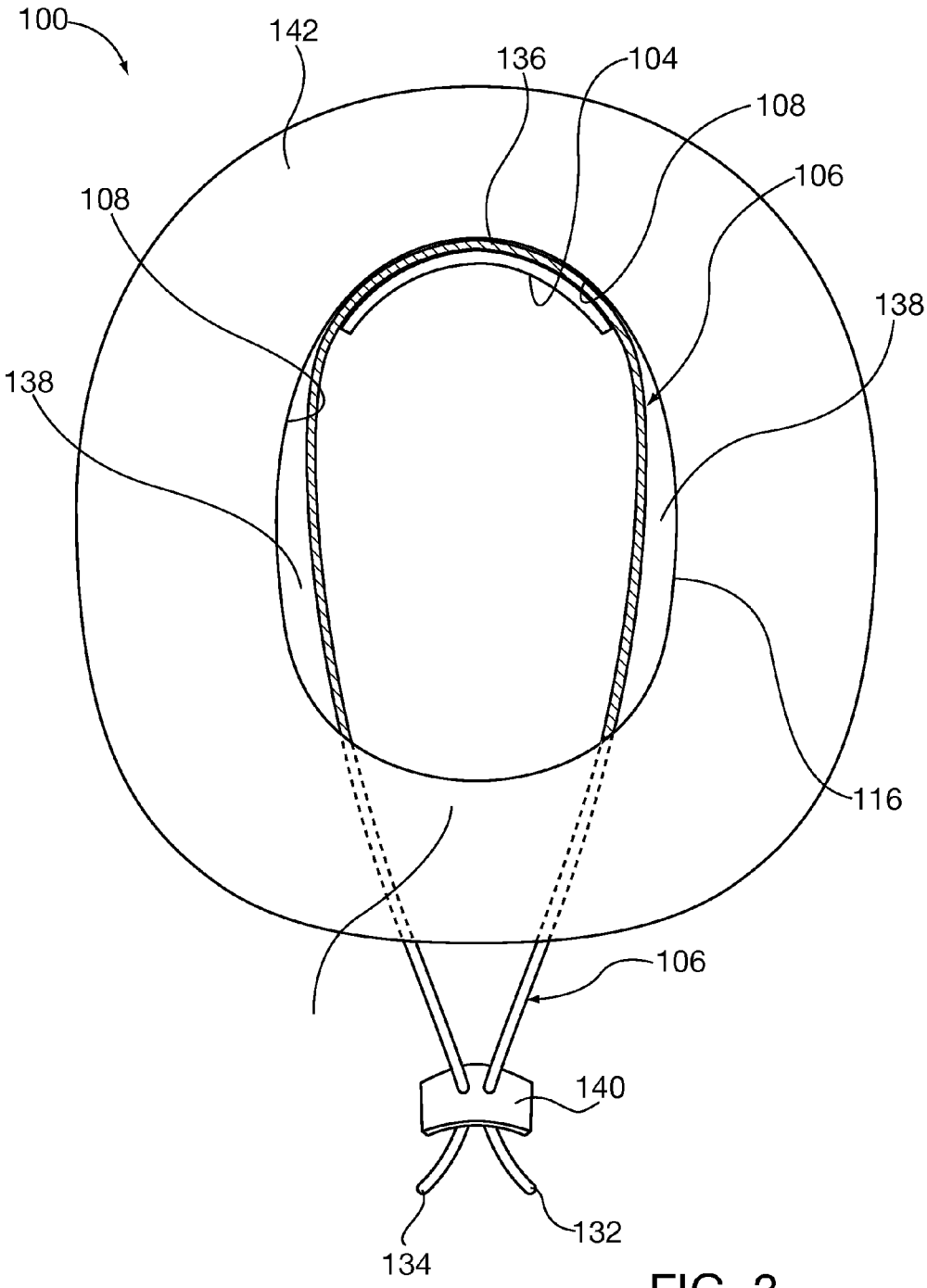
FIG. 3 is a bottom view of a hat.
Figure 4A:
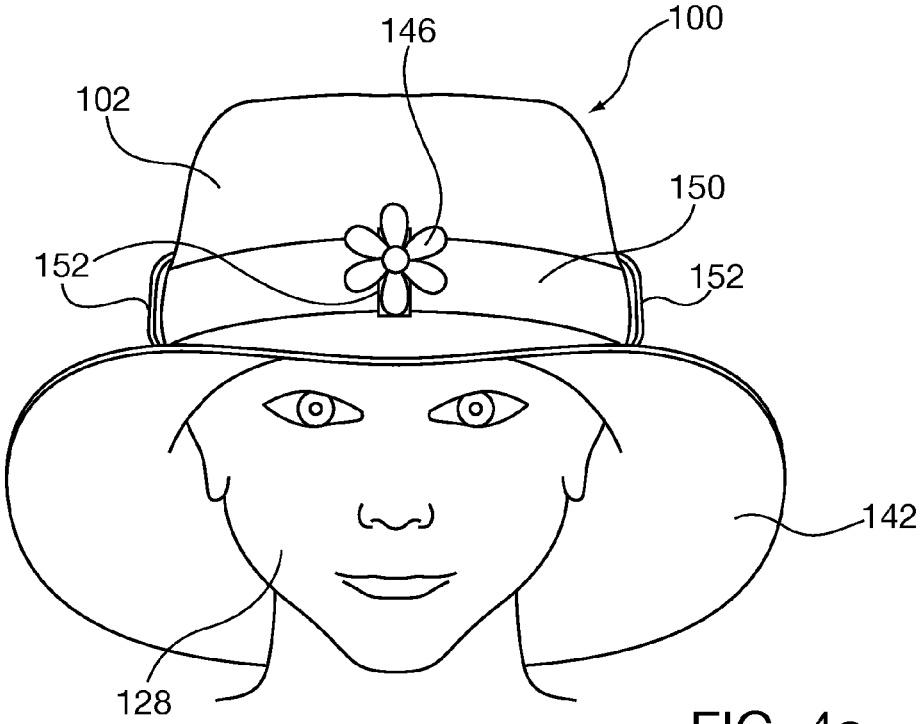
FIG. 4*a* is a front environmental view of a hat.
Figure 4B:
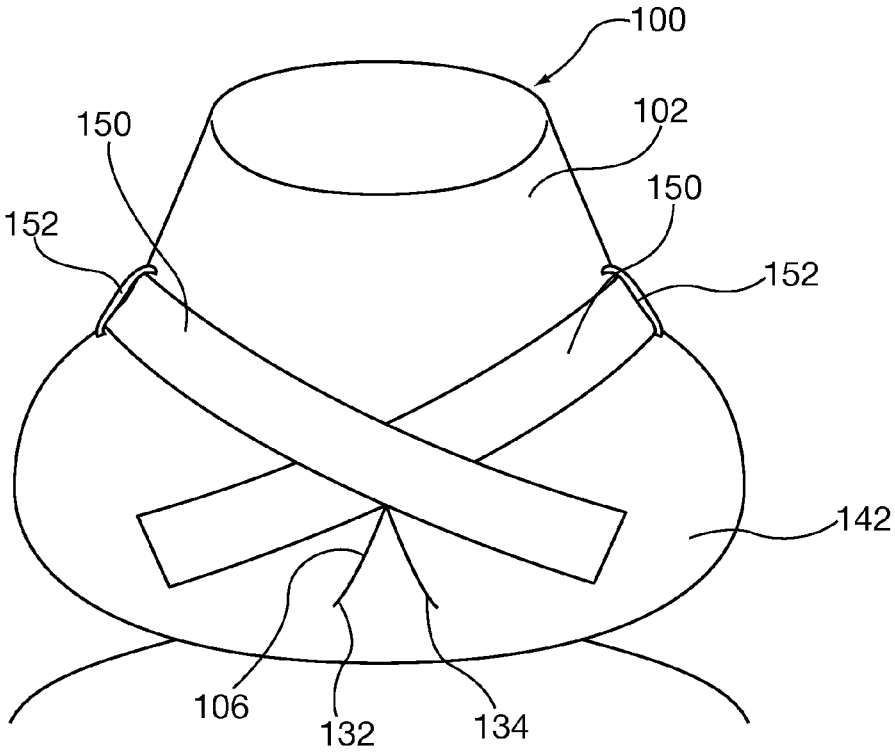
FIG. 4*b* is a rear environmental view of the hat of FIG. 4*a;*

The crown 102 includes an interior 108 having a forward portion 110. The crown 102 also includes an exterior 112 having a rearward portion 114. A circumferential bottom edge 116 separates the interior 108 and exterior 112. Furthermore, in one embodiment, the front 118 of the crown 102 has a first height 122 and the rear 120 of the crown 102 has a second height 124 wherein the second height 124 is greater than the first height 122. In one embodiment, the crown 102 is shaped, or otherwise sized, such that the rear of the bottom edge 116 rests below the entire occipital protuberance 126 of a user 128 when the user 128 is wearing the hat 100. Alternatively, the rear of the bottom edge 116 of the crown 102 may rest at the top of the nape of the neck 130 of the user 128. In an alternative embodiment, as shown in FIG. 1*b*, the rear 120 of the crown 102 may include a crown extension 121 that may rest below the entire occipital protuberance 126 of a user 128. The crown extension 121 may be added to an existing hat or be an integral part of an initial construction.

The band 104 is coupled to the interior 108 of the crown 102. The band 104 may be configured to absorb perspiration from the user 128. The band 104 may be positioned near the bottom edge of the crown 102. Additionally, the band 104 may be a circumferential piece that spans the entire circumference of the crown 102 or may be a smaller piece that does not span the entire circumference of the crown 102. In one embodiment, the band 104 is at least coupled adjacent to the forward portion 110 of the interior 108 of the crown 102.

The resilient member 106 includes a first end 132, a second end 134 and an intermediate portion 136 between the first and second ends 132, 134. The resilient member 106 may be formed from any suitable resilient material, including, but not limited to, rubber, an elastomer, Nylon®, any other suitable polymer, composite or the like. The intermediate portion 136 of the resilient member 106 is positioned between the band 104 and interior 108 of the crown 102. In one embodiment, the intermediate portion 136 is positioned between the forward portion 110 of the interior 108 of the crown 102 and the band 104. The first end 132 and second end 134 of the resilient member 106 extend through the exterior 112 of the crown 102. The resilient member 106 may be selectively tightened and loosened to accommodate users having different cranium sizes and/or adjust for a user's comfort. In one embodiment, once the resilient member 106 is tightened about the user's head, a gap 138 is formed between the resilient member 106 and the side portion of the bottom edge 116 of the crown 102 so that the gap 138 may provide increased ventilation to the interior 108 of the crown 102. The gap 138 also provides an area for the top portion of a user's ears such that the hat 100 can sit lower on the head without impinging on the ears. See FIG. 4*a*. The hat 100 may also include a toggle 140 releasably coupled to the resilient member 106 near at least one of the first and second ends 132, 134 wherein the resilient member 106 is operable to selectively tighten or loosen the resilient member 106. It will, however, be appreciated that the resilient member 106 may be tightened or loosened by any suitable means known in the art and such means are contemplated herein and considered part of the present disclosure. Once the hat 100 is disposed about the user's head, the resilient member 106 may be tightened such that the resilient member 106 engages the rear of the user's head below the entire occipital protuberance 126 to secure the hat 100 to the user's head.

Figure 5A:
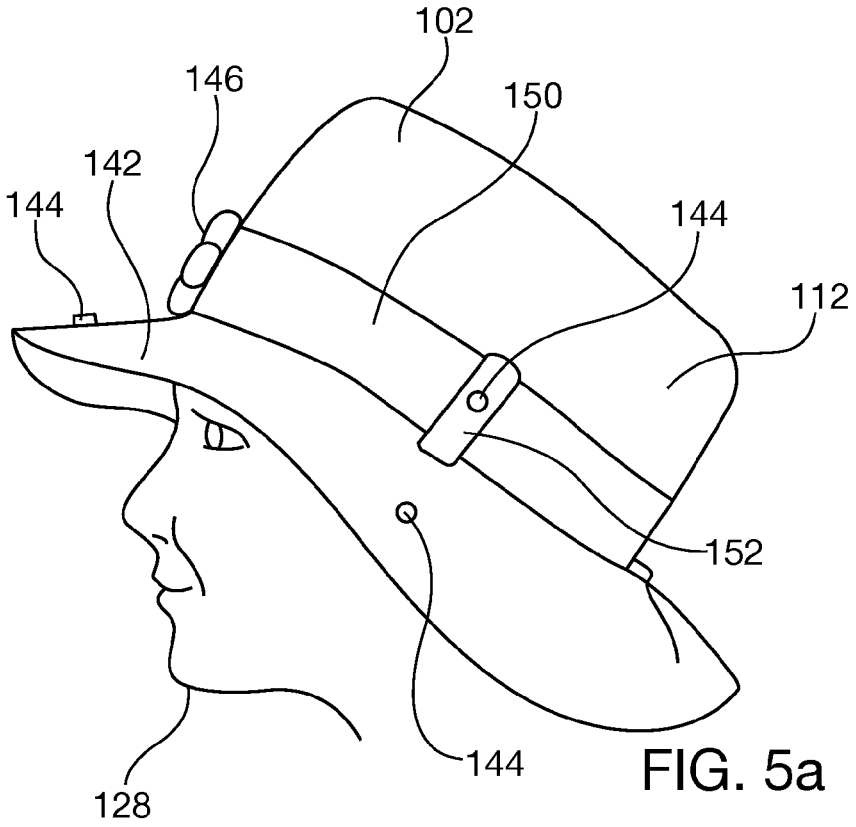
FIG. 5*a* is a side environmental view of a hat.
Figure 5B:
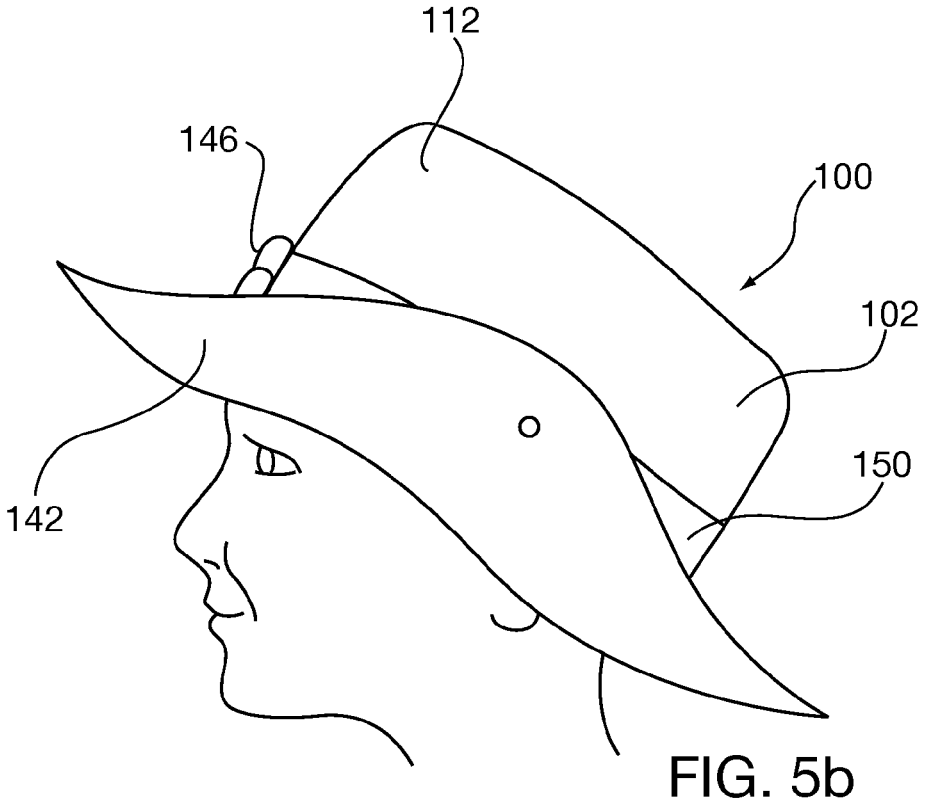
FIG. 5*b* is the hat of FIG. 5*a* with the brim in a brim second position.
Figure 5C:
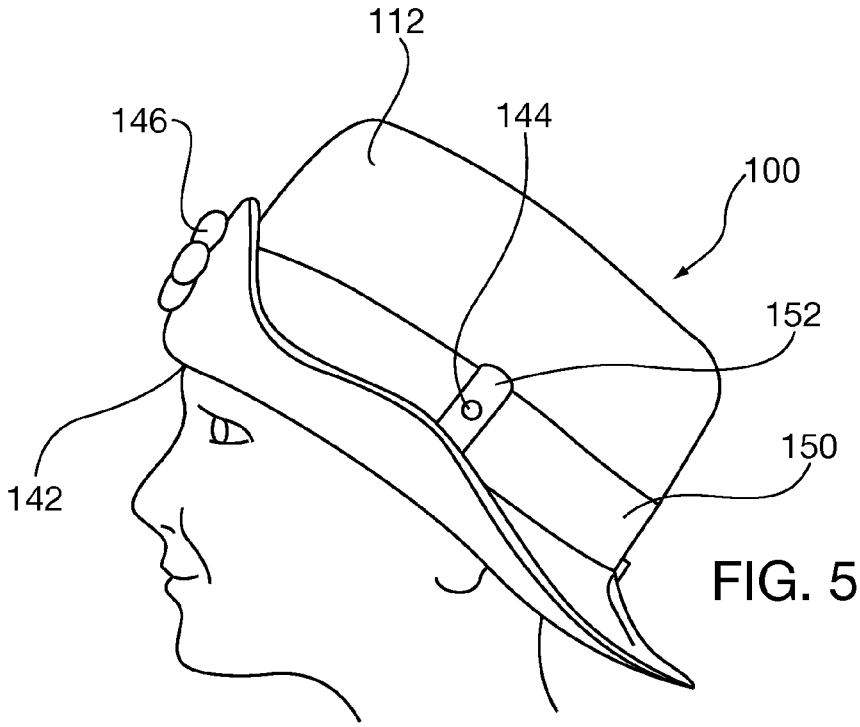
FIG. 5*c* is an alternative embodiment of the hat of FIG. 5*a* with the brim in a brim second position.
Figure 6:
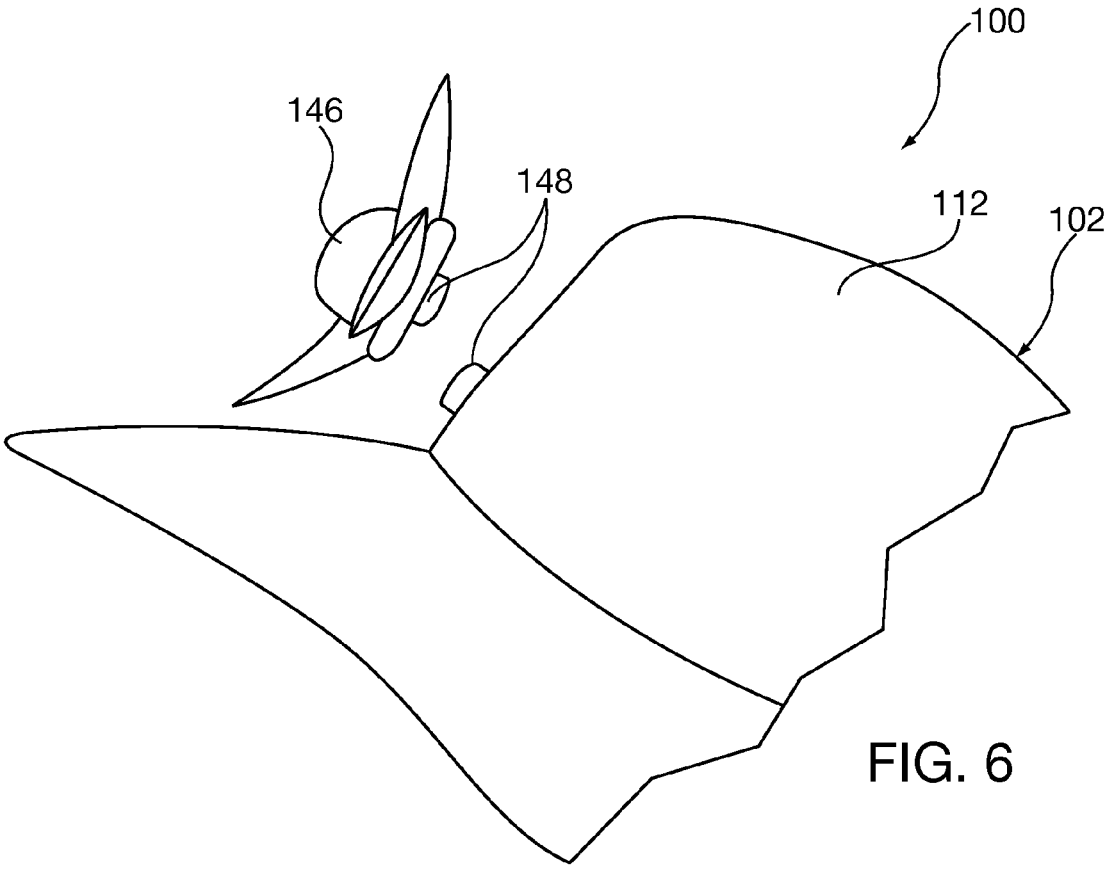
FIG. 6 is a schematic, partial side-view of a hat with an ornament.
Figure 7A:
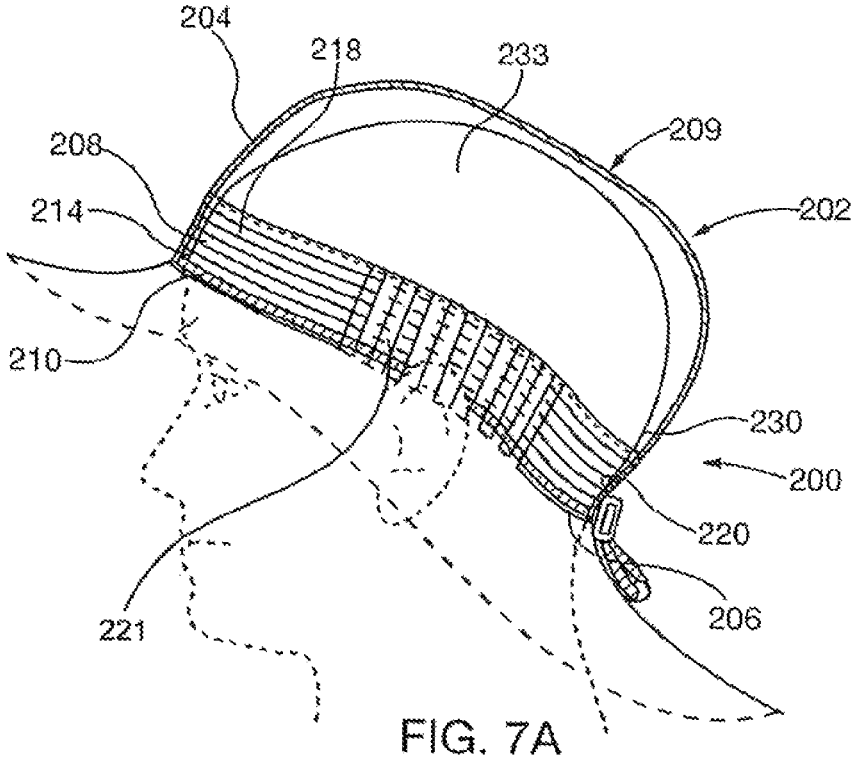
FIG. 7A is a side view of a hat having a fitting system.
Figure 7B:
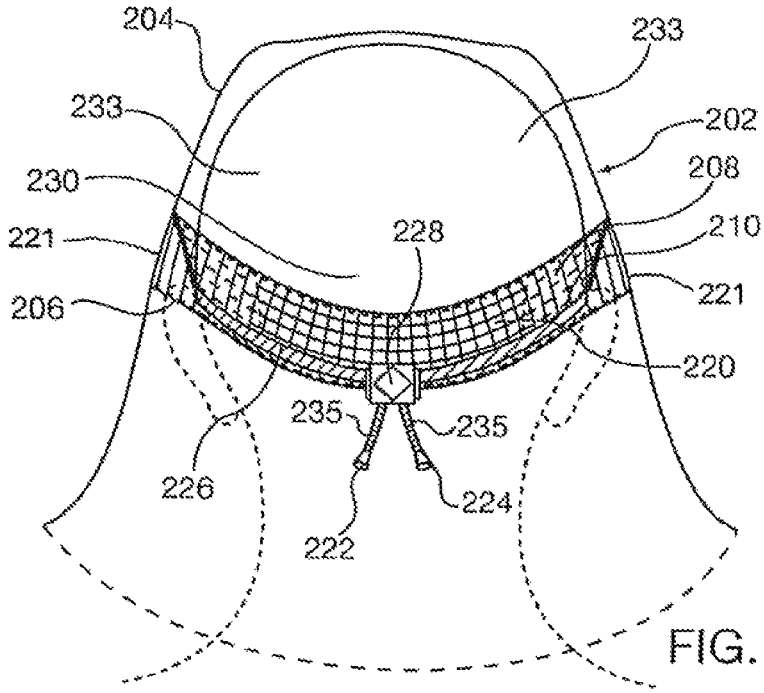
FIG. 7B is a rear view of the hat of FIG. 7A.

In one embodiment, a circumjacent brim 142 is coupled to the crown 102. The brim 142 may be integral with the crown 102. Alternatively, the brim 102 may be sewn to the crown 102, or coupled to the crown 102 via any suitable means, including, but not limited to, adhesive, fasteners, mechanical fasteners, bonding, sonic welding or any other suitable coupling means. At least a portion of the brim 142 may be movable between a first position and a second position so that the hat 100 may have one or more configurations selectable by the user. With particular reference to FIGS. 5*a*-5*c*, one or more attachment devices 144 may be coupled to at least one of the brim 142 and crown exterior 112 wherein each attachment device 144 is configured to releasably secure the brim 142 in the brim second position. In one embodiment, the attachment device 144 is operable to couple the brim 142 to the crown exterior 112 so that the brim 142 may be secured in the brim second position. Suitable attachment device(s) 144 include, without limitation, a button assembly, a buckle assembly, a clip assembly, a hook and loop assembly(Velcro®), a hook and catch assembly, a magnet assembly, an adhesive assembly, or any other suitable device, assembly or configuration operable to releasably couple the brim 142 in the brim second position to the crown 102. As shown in FIG. 5*b*, one or both sides of the brim 142 may be releasably coupled to the crown 102. Alternatively, as shown in FIG. 5*c*, the front and/or rear of the brim 142 may be releasably coupled to the crown 102. It will, however, be appreciated that any portion of the brim 142 may be releasably coupled in the brim second position to any suitable portion of the crown 102 and remain within the scope of the present disclosure.

The hat 100 may also include one or more ornaments 146 capable of being selectively and releasably coupled to the crown 102 and/or brim 142. The ornaments 146 may have any suitable configuration for selectively adding one or more ornamental aspects to the hat 100. At least one of each ornament 146 and crown 102 (and/or brim 142) may include an attachment device 148 for releasably coupling each ornament 146 to the hat 100. In one embodiment, at least one of the attachment device(s) 144 for securing the brim 142 in the brim second position to the crown 102 may be also employed to couple each ornament 146 to the hat 100. Alternatively, the attachment device(s) 148 for coupling each ornament 146 to the hat 100 may be separate from the attachment device(s) 144 for securing the brim 142 in the brim second position to the crown 102. The ornament or ornaments may be attached directly to the crown via attachment devices or, alternatively, attached via attachment devices to a loop portion 152. See FIG. 4*a* Suitable attachment device(s) 144 include, without limitation, a button assembly, a buckle assembly, a clip assembly, a hook and loop assembly(Velcro®), a hook and catch assembly, a magnet assembly, an adhesive assembly, or any other suitable device, assembly or configuration operable to releasably couple each ornament to the hat 100.

The hat 100 may also include one or more ornamental belts 150 for selectively encompassing at least a portion of the crown 102. Each belt 150 may be formed from any suitable material for adding an ornamental aspect to the hat 100. In one embodiment, each belt 150 has two sides and is selectively reversable by a user such that one belt 150 may provide at least two different ornamental aspects to the hat 100. In one embodiment, the crown 102 includes at least one loop 152 for releasably receiving at least one belt 150 whereby each belt may be releasably secured to the hat 100. The belt 150 may be releasably coupled to itself at the rear of the hat 100 to assist in releasably securing the belt 150 to the hat 100. Alternatively, each belt 150 may be secured to the crown 102 with one or more attachment device(s) the same, or substantially similar, to those previously mentioned.

Referring now to FIGS. 7A-7D, an alternative fitting system 200 for a hat 202 is shown. The hat 202 includes a crown 204 and a circumferential bottom edge 206 separating the interior of the crown 204 from the exterior 209 of the hat 202. The hat 202 may have any suitable style configuration, including, but not limited to bucket-style, derby, akubra, cowboy, fedora, gatsby, hardee, panama, beret, slouch, sombrero, trilby, etc.

The fitting system generally includes a band 208 configured to be coupled to the hat 202 and a resilient member 210. In one embodiment, as best shown in FIG. 7D, the band 208 includes a channel 212 for receiving a portion of the resilient member 210 therein. It will, however, be appreciated that the resilient member 210 may be retained by the band 208 via any suitable arrangement or configuration and remain within the scope of the present disclosure.

In one embodiment, the band 208 includes an outer portion 214 and an inner portion 216. The outer portion 214 is configured to be coupled to the hat 202. The inner portion 216 is configured to abut the user's head 233 whilst the user is wearing the hat 202. In an alternative embodiment, the inner portion may also be configured to be coupled to the hat 202 as well as abut the user's head 233 whilst the user is wearing the hat 202. It will be appreciated that the band 208 may have any suitable configuration, e.g., a single layer or any other suitable configuration, and remain within the scope of the present disclosure. The band 208 may be coupled to the hat 202 via any suitable means or device, including but not limited to sewing, stitching, bonding, adhesive or any other suitable coupling means or device(s). Also, the band 208, or any portion thereof, may be coupled to one or both of the hat crown 204 and hat bottom peripheral edge 206. It will, however, be appreciated that the band 208 or any other portion of the fitting system 200 may be coupled to the hat 200 via any suitable means or device and remain within the scope of the present disclosure.

The band 208 may be a single piece or may be formed from any suitable number of band portions. For example, and without limitation, in one embodiment, the band is formed from a front band portion 218 and a rear band portion 220. The band 208 may also include one or more side portions 221 (e.g., a left-side portion and a right-side portion). The band 208 may also include portions that may be trimmed off and/or overlapped thereby permitting a better fit of the fitting system 200 to the hat 202.

The band 208 may be formed from any suitable material, including, but not limited to, a synthetic material, a textile, a composite material or any other suitable material. The band 208, or portions thereof, may include additional padding to provide additional comfort to the user.

The resilient member 210 includes a first end 222, a second end 224 and an intermediate portion 226. In an alternative embodiment, the resilient member 210 may be formed from a plurality of resilient member sections. The plurality of resilient member sections may be coupled to one another or merely coupled to adjacent band portions. The resilient member 210 may be formed from any suitable resilient material as previously discussed.

Figure 8A:
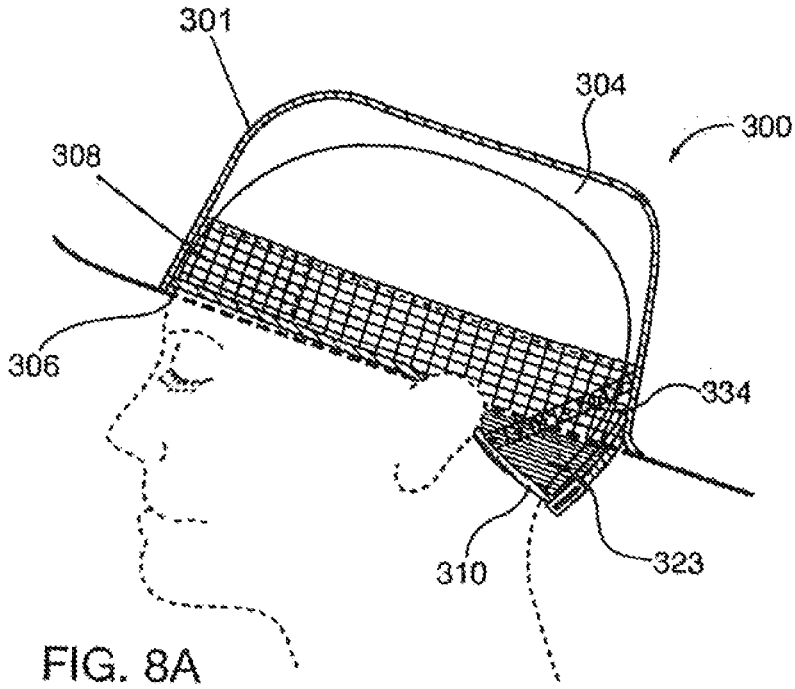
FIG. 8A is a side view of a hat having a fitting system.
Figure 8B:
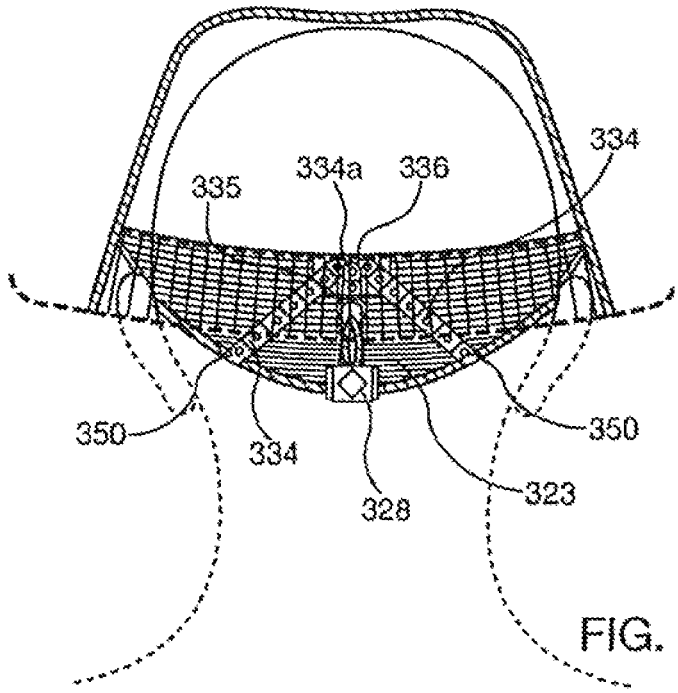
FIG. 8B is a rear view of the hat of FIG. 8A.
Figure 8C:
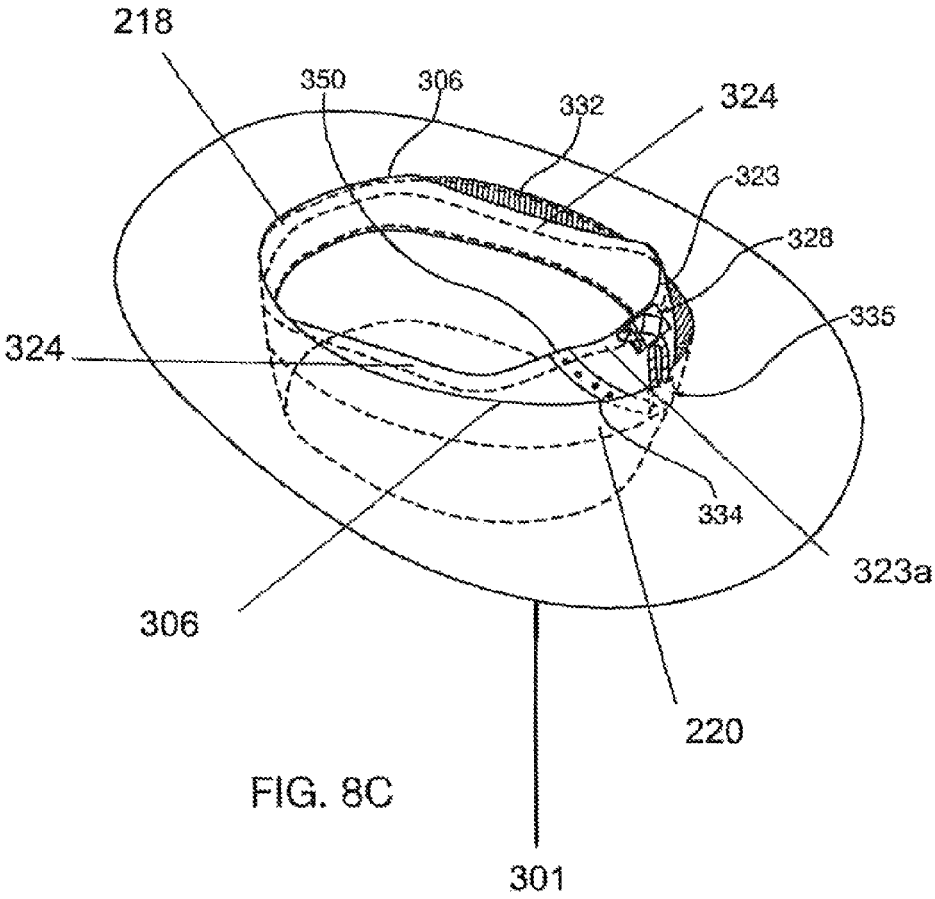
FIG. 8C is a schematic perspective bottom view of the hat of FIG. 8A.

The ends 222, 224 of the resilient member 210 may be coupled together in an end cap (see, e.g., FIGS. 8B and 8C for an illustrative end cap 335). The end cap may be configured to be selectively coupled to the hat 202. For example, the end cap may include one or more hook members, magnet, clip or other fasteners that are releasably coupleable to a corresponding fastener member on the hat 202. In an alternative embodiment, the ends 222, 224 of the resilient member 210 may be secured together by any other suitable means such as sewing, adhesive, fastener(s) or any other suitable means. In yet another alternative, the ends 222, 224 of the resilient member 210 may not be coupled together and merely finished off with individual end caps 235. The individual end caps 235 may have fastening members that are selectively coupleable to corresponding fastener members on the hat 202 as previously discussed.

The fitting system 200 may also include a cord lock 228 releasably secured near at least one end of the resilient member 210. The cord lock 228 may be configured to permit a user to adjust the tightness of the fitting system 200 by adjusting the length of the resilient member ends protruding through the cord lock 228.

The fitting system 200 may be configured such that the resilient member 210 and at least a portion of the band 208 rests below the entire occipital protuberance 230 of the user's head 233. The fitting system 200 may also be configured such that the resilient member 210 and at least a portion of the band 208 follows the contours of the user's head 233 to secure the hat 202 to the user's head 233. To this end, in one embodiment, the fitting system may include side gaps 232 adjacent to the sides of the user's head 233 and between the fitting system 200 and portions of the hat crown 204.

The fitting system 200 may be coupled to any suitable hat 202. At least a portion of the band 208 is coupled to one or both of the hat crown 204 and bottom edge 206. The hat 202 may then be placed about a user's head 233. The user may adjust the fit of the hat 202 by drawing one or both ends 222, 224 of the resilient member 208 through the cord lock 228 and secure the ends 222, 224 in place therewith.

Referring now to FIGS. 8A-8C, an alternative fitting system 300 is shown. The fitting system 300 is substantially similar to the fitting system 200 of FIGS. 7A-7D and a correlation of parts is generally indicated in this embodiment by indexing the numerals in FIGS. 7A-7D by 100 and referencing the same structural equivalents to by the same numeral.

The illustrative embodiment, the band 308 includes a crown extension 323 that extends from the rear of the crown 304 past the hat 301 circumferential bottom edge 306. The crown extension 323 also positions a portion of the resilient member 310 below the hat 301 circumferential bottom edge 306. The crown extension 323 is coupled to one or both of the hat 301 crown 304 and bottom edge 306.

In one embodiment, the crown extension 323 is formed from a first flexible material, such as, but not limited to, a breathable knit or woven fabric, webbing, elastic, or mesh. In one embodiment, the crown extension 323 further includes a second flexible material, such as, but not limited to textiles, woven paper, straw, bamboo, leather, felt, natural fabrics, or synthetic fabrics that cover the first flexible material, flexible support members 334, and the band 308. In one embodiment, the second flexible material is the same as the material that forms the crown and/or brim of the hat. Alternatively, the second flexible material is different from the hat material.

The band (308) includes a resilient member (310), the resilient member (310) having a first end (222), a second end (224), and an intermediate portion (226) between the first (222) and second (224) ends; wherein a front band portion (218) spans across and surrounds at least the forehead of a user's head when the hat (301) is positioned on the user, a rear band portion (220), a crown extension (323) formed integrally with the rear band portion (220) and extending downwardly from the rear band portion (220) to a crown extension bottom edge (323*a*) which is adapted to lie entirely below the occipital protuberance of the user's head when the hat (301) is positioned on the user. The front band portion (218) and the rear band portion (220) are attached to a circumferential bottom edge (306) of the hat (301); wherein the crown extension (323) and the crown extension bottom edge (323*a*) extend downwardly below said circumferential bottom edge (306) of the hat (301). A first side band portion (324) and a second side band portion (324), respectively, are adapted to lie directly adjacent to the sides of the user's head when the hat (301) is positioned on the user. In this embodiment, the resilient member (310) is only positioned within the front band portion (218), the first side band portion (324), the second side band portion (324), and the crown extension (323) as shown in FIGS. 8A-8C. The intermediate portion (226) of the resilient member (310) extends from the front band portion (218) to both the first side band portion (324) and the second side portion (324). The first side band portion (324) and second side band portion (324) are adapted to attach to an interior side of the crown (304) such that side gaps (332) are formed between the first side band portion (324) and the second side band portion (324) and the circumferential bottom edge (306) of the hat, respectively; each of the side gaps (332) are designed to receive the top portion of the user's ear so that the hat (301) is designed to sit lower on the user's head without impinging upon the user's ears when the hat (301) is worn.

One or more flexible support members 334 extend from the center portion 336 of the crown extension 323. In one embodiment, the flexible support members 334 radiate downwardly and outwardly from the center portion 336 of the crown extension 323. In one embodiment, the flexible support members 334 are adjustable such that the height and angle of each flexible support member 334 relative to one another as well as their relative positions on the crown extension 323 may be adjusted to accommodate various sizes of hats and user's heads. In one embodiment, one or more of the flexible support members 334 include a looped portion 350 for receiving a portion of the resilient member 310 therein. In an alternative embodiment, a plurality of flexible support members are used in lieu of a crown extension. The fitting system 300 may include side gaps 332 as shown in FIG. 8C.

In one embodiment, a central flexible support member 334*a* serves as an attachment point of the crown extension first flexible material. In another embodiment, a central flexible support member 334*a* serves as an attachment point for the crown extension second flexible material. In yet another embodiment, a secondary central vertical support member may be layered in front of a primary central vertical support member, effectively enclosing the finished edges and attachment of the first or second flexible material between the primary central vertical support member and the secondary central vertical support member.

The flexible support members 334 may be formed from any suitable material, including, but not limited to boning, webbing, polymer, interfacing or any other suitable material. Additionally, one or more flexible support member 334 may serve as an attachment for the cord lock 328. One or more of the flexible support members 334 may also serve as an attachment point for a fastener member for receiving one or more end caps at the ends of the resilient member.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A fitting system (300) designed to be attached to a crown (304) of a hat (301), the fitting system (300) comprising:

a band (308) operable to be coupled to the hat (301), wherein the band (308) includes a resilient member (310), the resilient member (310) having a first end (222), a second end (224), and an intermediate portion (226) between the first (222) and second (224) ends;

a front band portion (218) that spans across and surrounds at least the forehead of a user's head when the hat (301) is positioned on the user, a rear band portion (220), a crown extension (323) formed integral with the rear band portion (220) and extending downwardly from the rear band portion (220) to a crown extension bottom edge (323*a*) which is adapted to lie entirely below the occipital protuberance of the user's head when the hat (301) is positioned on the user; wherein the front band portion (218) and the rear band portion (220) are attached to a circumferential bottom edge (306) of the hat (301); wherein the crown extension (323) and the crown extension bottom edge (323*a*) extend downwardly below said circumferential bottom edge (306) of the hat (301); and a first side band portion (324) and a second side band portion (324) which are respectively adapted to lie directly adjacent to the sides of the user's head when the hat (301) is positioned on the user;

wherein the resilient member (310) is only positioned within the front band portion (218), the first side band portion (324), the second side band portion (324), and the crown extension (323); wherein the intermediate portion (226) of the resilient member (310) extends from the front band portion (218) to both the first side band portion (324) and the second side portion (324); the first side band portion (324) and second side band portion (324) are adapted to attach to an interior side of the crown (304) such that side gaps (332) are formed between the first side band portion (324) and the second side band portion (324) and the circumferential bottom edge (306) of the hat (301), respectively; each of the side gaps (332) are designed to receive the top portion of the user's ear so that the hat (301) is designed to sit lower on the user's head without impinging upon the user's ears when the hat (301) is worn;

the resilient member (310) extending from both of the first side band portion (324) and the second side band portion (324) downwardly into the crown extension (323) such that the resilient member (310) is only attached to the crown extension bottom edge (323*a*) and is positioned below the entire occipital protuberance of the user when the hat (301) is positioned on the user; wherein the first end (222) and second end (224) of the resilient member (310) extend through an exterior side of the crown extension (323) so that the fitting system (300) can be selectively tightened or loosened to secure the hat (301) to the user's head.

2. The fitting system (300) of claim 1 wherein the band (308) includes a channel (212) for receiving at least the intermediate portion (226) of the resilient member (310).

3. The fitting system (300) of claim 1 further comprising at least one flexible support member (334) coupled to the crown extension (323).

4. The fitting system (300) of claim 1 further comprising at least one flexible support member (334) coupled to the hat (301) and to extend to and engage at least one of the band (308) and resilient member (310).

5. The fitting system (300) of claim 4 wherein each flexible support member (334) includes a looped section (350) adapted to receive a portion of the resilient member (310).

6. The fitting system (300) of claim 1 wherein the resilient member (310) is formed from a plurality of resilient member sections.

7. The fitting system (300) of claim 1 further comprising at least one cord lock (328) releasably secured near at least one of the first (222) and the second (224) ends of the resilient member (310).

8. The fitting system (300) of claim 7 wherein the cord lock (328) is also releasably coupleable to the crown extension (323).

9. The fitting system (300) of claim 1 further comprising an endcap (335), wherein the first end (222) of the resilient member (310) and second end (224) of the resilient member (310) are coupled to the endcap (335).

10. The fitting system (300) of claim 9 wherein the endcap (335) is releasably coupleable to one of the hat (301) and the band (308).

11. The fitting system (300) of claim 1 wherein the first end (222) of the resilient member (310) and second end (224) of the resilient member (310) are secured to each other so that the resilient member (310) forms a continuous loop.

12. A method for creating an adjustable hat comprising:

providing the fitting system (300) of claim 1, coupling the band (308) to one or more of the crown (304) of the hat (301) and the circumferential bottom edge (306).

13. The method of claim 12 wherein the band (308) includes a channel (212) for receiving at least the intermediate portion (226) of the resilient member (310).

* * * * *